US009146073B1

(12) United States Patent
Roy

(10) Patent No.: US 9,146,073 B1
(45) Date of Patent: Sep. 29, 2015

(54) SLING FOR ARCHERY BOW

(71) Applicant: Andre Roy, Wawa (CA)

(72) Inventor: Andre Roy, Wawa (CA)

( * ) Notice: Subject to any disclaimer, the term of this patent is extended or adjusted under 35 U.S.C. 154(b) by 15 days.

(21) Appl. No.: 14/100,445

(22) Filed: Dec. 9, 2013

Related U.S. Application Data

(60) Provisional application No. 61/734,434, filed on Dec. 7, 2012.

(51) Int. Cl.

| | |
|---|---|
| ***A45F 3/14*** | (2006.01) |
| ***A45F 3/04*** | (2006.01) |
| ***F41B 5/14*** | (2006.01) |
| ***F41B 5/06*** | (2006.01) |
| ***A45F 5/00*** | (2006.01) |

(52) U.S. Cl.
CPC ..... *F41B 5/1461* (2013.01); *A45F 3/14* (2013.01); *A45F 5/004* (2013.01); *F41B 5/063* (2013.01); *F41B 5/066* (2013.01); *F41B 5/14* (2013.01)

(58) Field of Classification Search
CPC ..... F41B 5/066; F41B 5/063; F41B 5/1461; F41B 5/14; F41B 5/004
USPC ..... 224/162, 257, 258, 916, 917, 260
See application file for complete search history.

(56) References Cited

U.S. PATENT DOCUMENTS

| | | | | |
|---|---|---|---|---|
| 2,614,355 | A | 10/1952 | Rogers et al. | |
| 3,198,300 | A * | 8/1965 | Tuttle | 16/405 |
| 3,998,367 | A | 12/1976 | Harding | |
| 4,768,689 | A * | 9/1988 | Davis | 224/257 |
| 5,065,732 | A * | 11/1991 | Smith | 124/88 |
| 5,499,752 | A * | 3/1996 | Johnson | 224/258 |
| 5,730,341 | A * | 3/1998 | Hester, Jr. | 224/257 |
| 5,746,192 | A * | 5/1998 | Gissel | 124/1 |
| 5,897,039 | A | 4/1999 | Swenke | |
| 5,911,216 | A | 6/1999 | Killian | |
| 7,059,504 | B2 | 6/2006 | Suggs | |
| 8,123,092 | B2 | 2/2012 | Krulik et al. | |
| 8,622,265 | B2 * | 1/2014 | Arajakis | 224/257 |
| 2004/0084490 | A1 * | 5/2004 | Caputi | 224/257 |
| 2012/0048900 | A1 * | 3/2012 | Wong | 224/257 |

* cited by examiner

*Primary Examiner* — Justin Larson
*Assistant Examiner* — Lester L Vanterpool
(74) *Attorney, Agent, or Firm* — Robert C. Montgomery; Montgomery Patent & Design, LLC

(57) ABSTRACT

A sling for suspending an archery bow from an archer's shoulder comprises a pair of retracting mechanisms, each being attached to a shoulder pad using cords. The cords balance the bow while being suspended from the shoulder pad. The sling allows a supported carry position for the bow about the upper leg and hip of the archer. When ready to shoot an arrow, as the bow is brought to the shooting position, the shoulder pad slides off the archer's shoulder allowing the retracting mechanisms to draw the sling out to an offset position. In this manner, as the bow is taken from the archer's shoulder, the sling is quietly drawn tight between the retracting mechanisms and out of the way of the archer's use of the bow.

15 Claims, 5 Drawing Sheets

SLING FOR ARCHERY BOW

RELATED APPLICATIONS

The present invention was first described in and claims the benefit of U.S. Provisional Application No. 61/734,434, filed Dec. 7, 2012, the entire disclosures of which are incorporated herein by reference.

FIELD OF THE INVENTION

The present invention relates generally to a sling for suspending an archery bow upon a user for field carrying of the bow.

BACKGROUND OF THE INVENTION

There modern advances in bow hunting equipment have enhanced the sport, providing hunters with increased success. Hunters commonly transport gear to a field site in a backpack or special case, however transporting the bow itself presents a problem. Many hunters simply carry it in their hand which quickly becomes heavy no matter how light the bow is. Others may place it in a case, but removing it from the case is a noisy and time consuming process if it is quickly needed for a shot. Some hunters may carry it with the bow string over their shoulder which subjects the bow to damage and can become painful to one's shoulder. Accordingly, there exists a need for a means by which a hunting bow can easily be carried, without the disadvantages as described above.

SUMMARY OF THE INVENTION

The disadvantages of the prior art are overcome by the present invention in providing a sling for suspending an archery bow from an archer's shoulder. The sling comprises a pair of retracting mechanisms, each being attached to a shoulder pad using cords. The cords balance the bow while being suspended from the shoulder pad. The sling allows a supported carry position for the bow about the upper leg and hip of the archer. When ready to shoot an arrow, as the bow is brought to the shooting position, the shoulder pad slides off the archer's shoulder allowing the retracting mechanisms to draw the sling out to an offset position. In this manner, as the bow is taken from the archer's shoulder, the sling is quietly drawn tight between the retracting mechanisms and out of the way of the archer's use of the bow. Thus, the use of the present invention provides for the easy transportation of a bow under field conditions, but allows it to remain instantly available for quiet and stealthy use.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
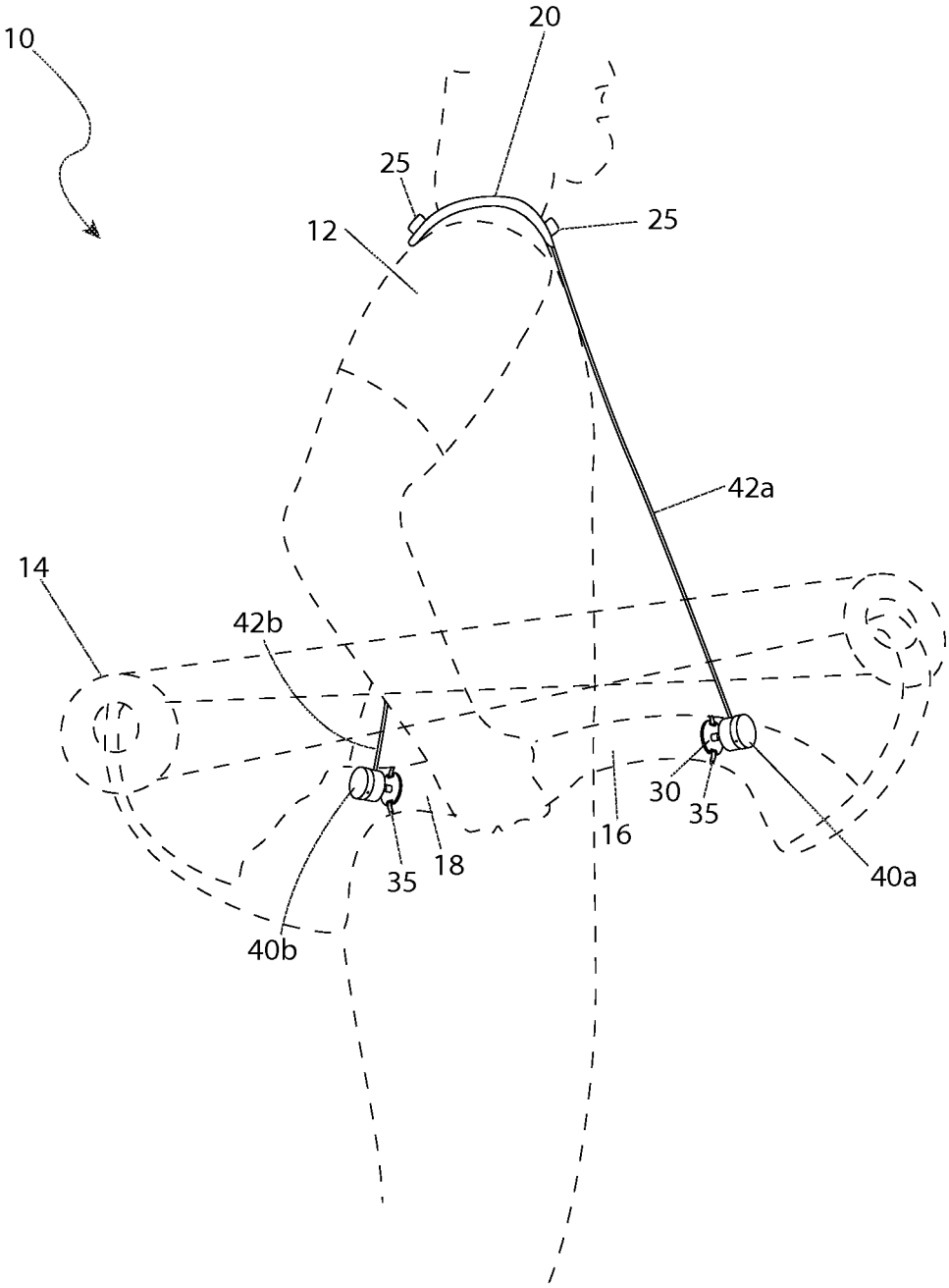
FIG. 1 is an environmental view of a sling for an archery bow 10, according to a preferred embodiment of the present invention.

10 sling
12 archer
14 bow
16 upper riser
18 lower riser
20 shoulder pad
22*a* upper covering
22*b* lower covering
23 padding
24 tie-down aperture
25 tie down
26 tie-down center
27 tie-down bottom
28 tie-down upper
29 post member
30 mounting assembly
31 platen
32 rubber pad
35 strap
37 hook-and-loop surface
38 strap fastener
40*a* first retracting mechanism
40*b* second retracting mechanism
41 spool assembly
42*a* first cord
42*b* second cord
43 housing assembly
43*a* housing cup
44*a* spring cavity
44*b* first spring slot
44*c* second spring slot
44*d* spring holder cover
45 "O"-ring
46 spring
47 spool
48 spring holder
49 spool post
50 friction disc
51 cap post
52 cap
53*a* post threaded portion
53*b* spindle threaded portion
54 spindle
55*a* cap threaded portion
55*b* housing cup threaded portion
57 bearing
59 set screw
60 cord aperture

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the specifically described embodiment. A person skilled in the art will appreciate that many other embodiments of the invention are possible without deviating from the basic concept of the invention. Any such work around will also fall under scope of this invention. While only one particular configuration is shown and described that is for purposes of clarity and disclosure and not by way of limitation of scope.

Figure 2:
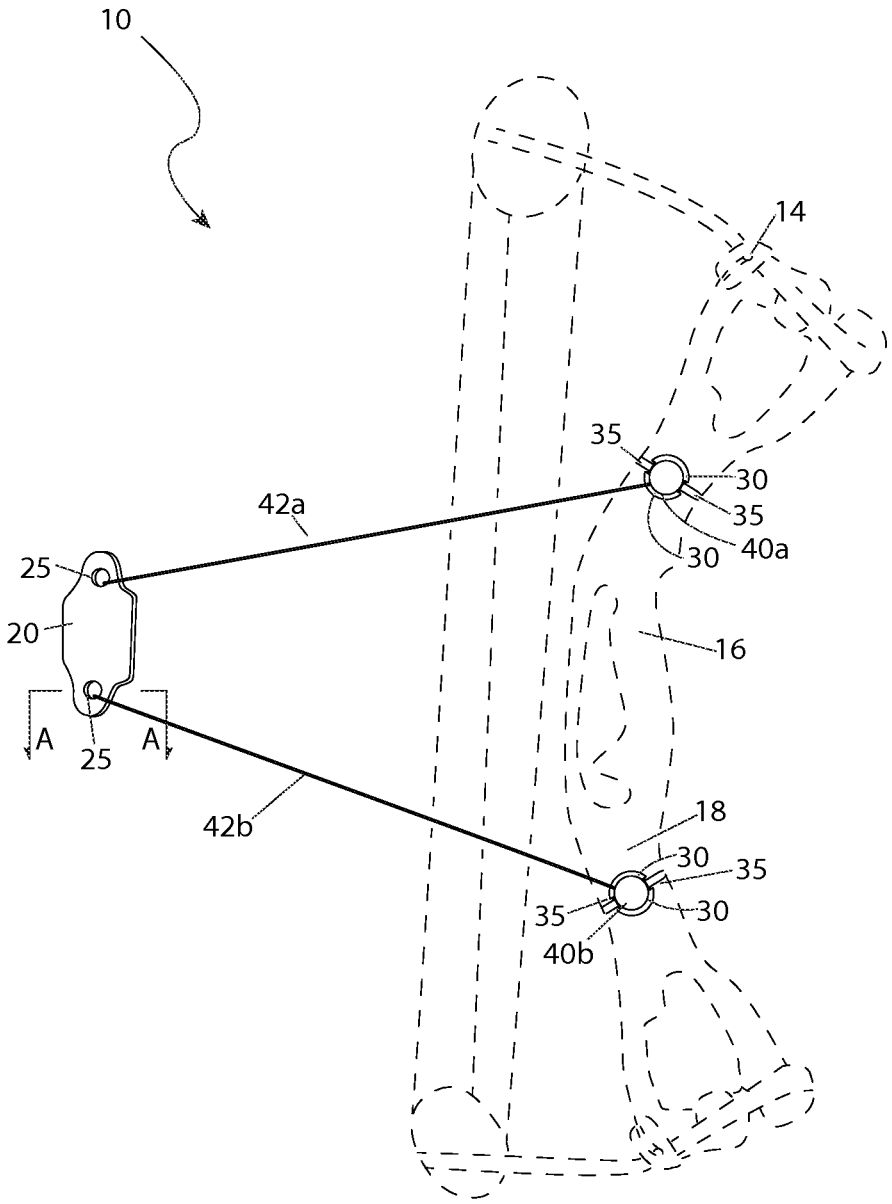
FIG. 2 is a side view of the sling for an archery bow 10, according to a preferred embodiment of the present invention.

The present invention describes a sling (herein described as the "apparatus") 10, which provides a means for suspending a bow 14 from an archer's 12 shoulder. Referring now to FIGS. 1 and 2, environmental and side views of the apparatus 10, according to the preferred embodiment of the present invention, are disclosed. The apparatus 10 comprises a shoulder pad 20, a first retracting mechanism 40*a*, a second retracting mechanism 40*b*, a first cord 42*a*, and a second cord 42*b*. The shoulder pad 20 provides comfort to the archer's 12 shoulder as the bow 14 is suspended upon the cords 42*a*, 42*b*. Each cord 42*a*, 42*b* is attached at one (1) end to the shoulder pad 20 via respective tie downs 25, and at opposing ends to respective retracting mechanisms 40*a*, 40*b*. Upon removal of the shoulder pad 20 from the archer's shoulder, the cords 42*a*, 42*b* are recoiled to a stowed position within each retracting mechanism 40*a*, 40*b*, thereby positioning the shoulder pad 20 along a side surface of the bow 14 in an offset manner. In this manner, as the bow is taken from the archer's shoulder, the sling is quietly drawn tight between the retracting mechanisms 40*a*, 40*b* and out of the way of the archer's use of the bow.

The apparatus 10 is removably attached to the bow 14 and easily removed via respective wrap-around straps 35 having hook-and-loop surfaces 37 (see FIG. 3). The bow 14 is envisioned to be at a hip height when it is suspended from the shoulder of the archer 12 using the apparatus 10. In this position, the bow 14 may be nocked with an arrow and ready to shoot. The apparatus 10 is depicted as being attached to an existing compound-type bow, yet it is known that other bow-types may be utilized without limiting the scope of the apparatus 10.

Figure 4:
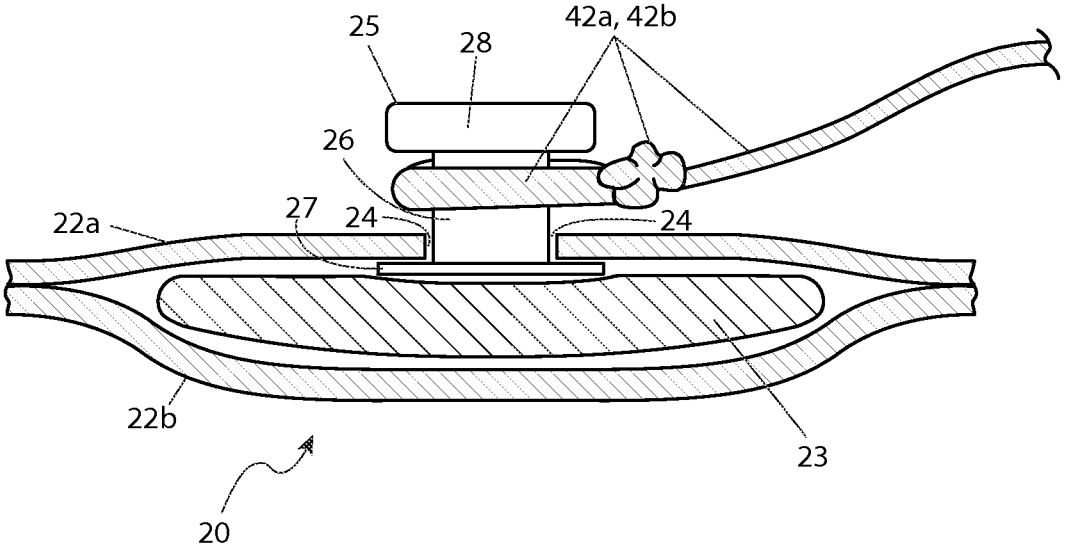

The shoulder pad 20 is generally rectangular in shape having a two-layer double-stitched fabric or leather covering with a layer of padding and at least one tie-down for attachment to the retracting cords. It is constructed to provide comfort to the shoulder of the archer. Referring now to FIG. 4, a sectional view of the shoulder pad 20 taken along section line A-A (see FIG. 2), according to a preferred embodiment of the present invention. The shoulder pad 20 comprises an upper covering 22*a* and a lower covering 22*b* with a padding portion 23 disposed there between. The upper covering 22*a* further comprises at least one aperture 24 in which a tie down 25 is disposed. The at least one tie-down 25 provides a "I"-shaped appendage which allow tying a particular length of the cords 42*a*, 42*b* thereto such that the bow 14 is positioned at an archer's hip area when the cords 42*a*, 42*b* are fully extended. The shoulder pad 20 being 12. The shoulder pad 20 is envisioned to be fabricated from a water-resistant material. Furthermore, the external portions of the apparatus 10 are envisioned to be made available in various colors and patterns to accommodate the archer's 12 preference such as various camouflage patterns, and the like.

As shown in FIGS. 1 and 2, a separate tie-down 25 is used for each cord 42*a* and 42*b*. Each tie down 25 is generally spool shaped and includes a perpendicular circular flat bottom portion 27 which is entrapped between the upper cover 22*a* and the padding 23, an integral top button-head 28, or similar feature, and a center portion 26. The cords 42*a*, 42*b* are wrapped around the center portion 26, knotted, and fixed in position thereto. The tie downs 25 are envisioned to be fabricated from durable materials such as plastic, rubber, or the like, yet it is known that other materials may be utilized without limiting the scope of the invention. It is envisioned that other styles and configurations of the present invention can be easily incorporated into the teachings of the present invention, and only one particular configuration shall be shown and described for purposes of clarity and disclosure and not by way of limitation of scope.

The cords 42*a*, 42*b* are envisioned to be fabricated from an anti-abrasion loop string, commonly utilized in the sport of archery. The cords 42*a*, 42*b* are preferably cut and retied onto the tie downs 25, thereby enabling easy adjustment of a length dimension so as to position the bow 14 at the hip height of the archer 12. The opposing ends of the cords 42*a*, 42*b* are attached to the respective retracting mechanisms 40*a*, 40*b* which are mounted upon the bow 14 (see FIGS. 3*a* and 3*b*).

Figure 3A:
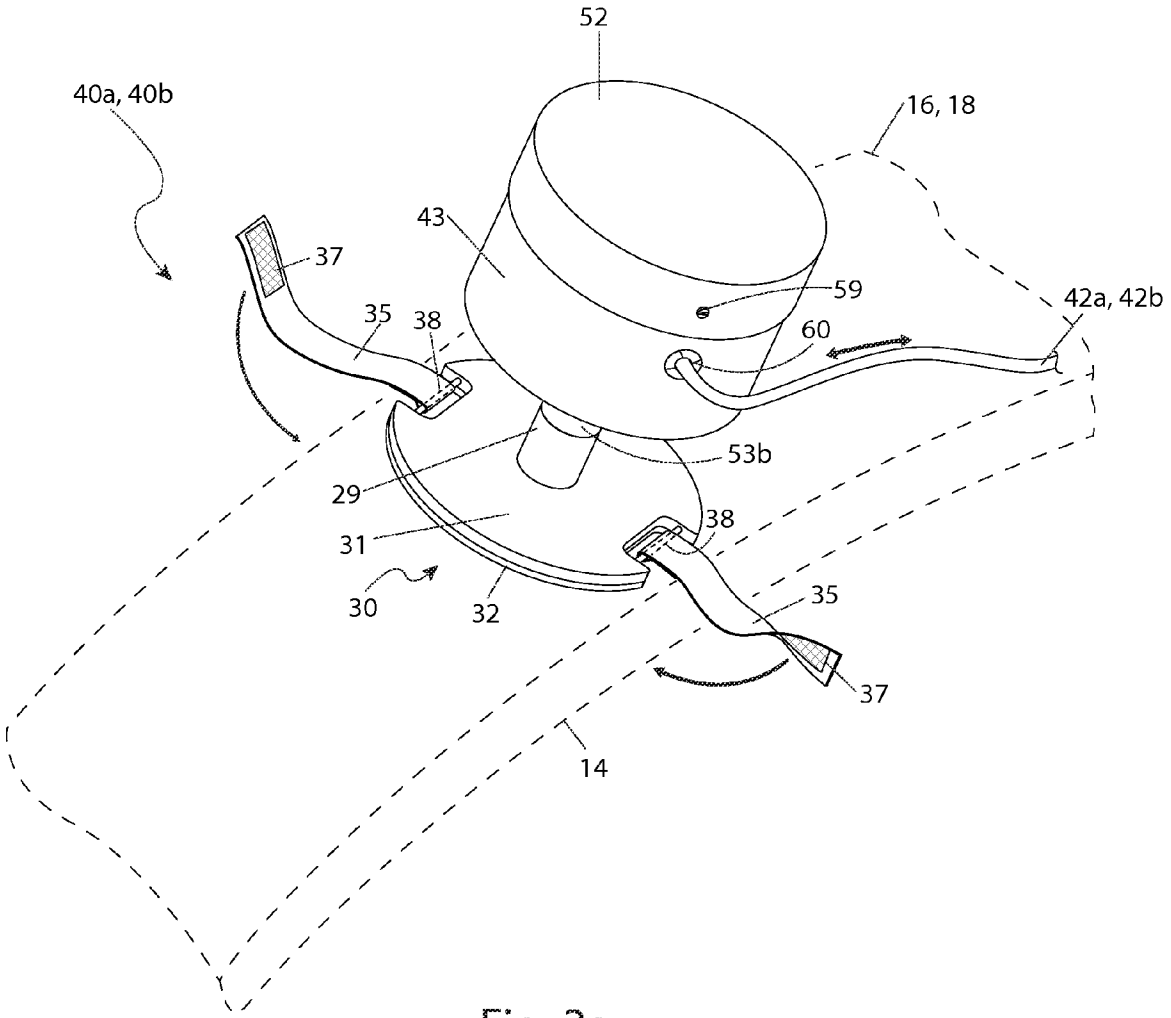
FIG. 3*a* is a perspective view of a retracting mechanism portion 40*a*, 40*b* of the sling for an archery bow 10, according to a preferred embodiment of the present invention.
Figure 3B:
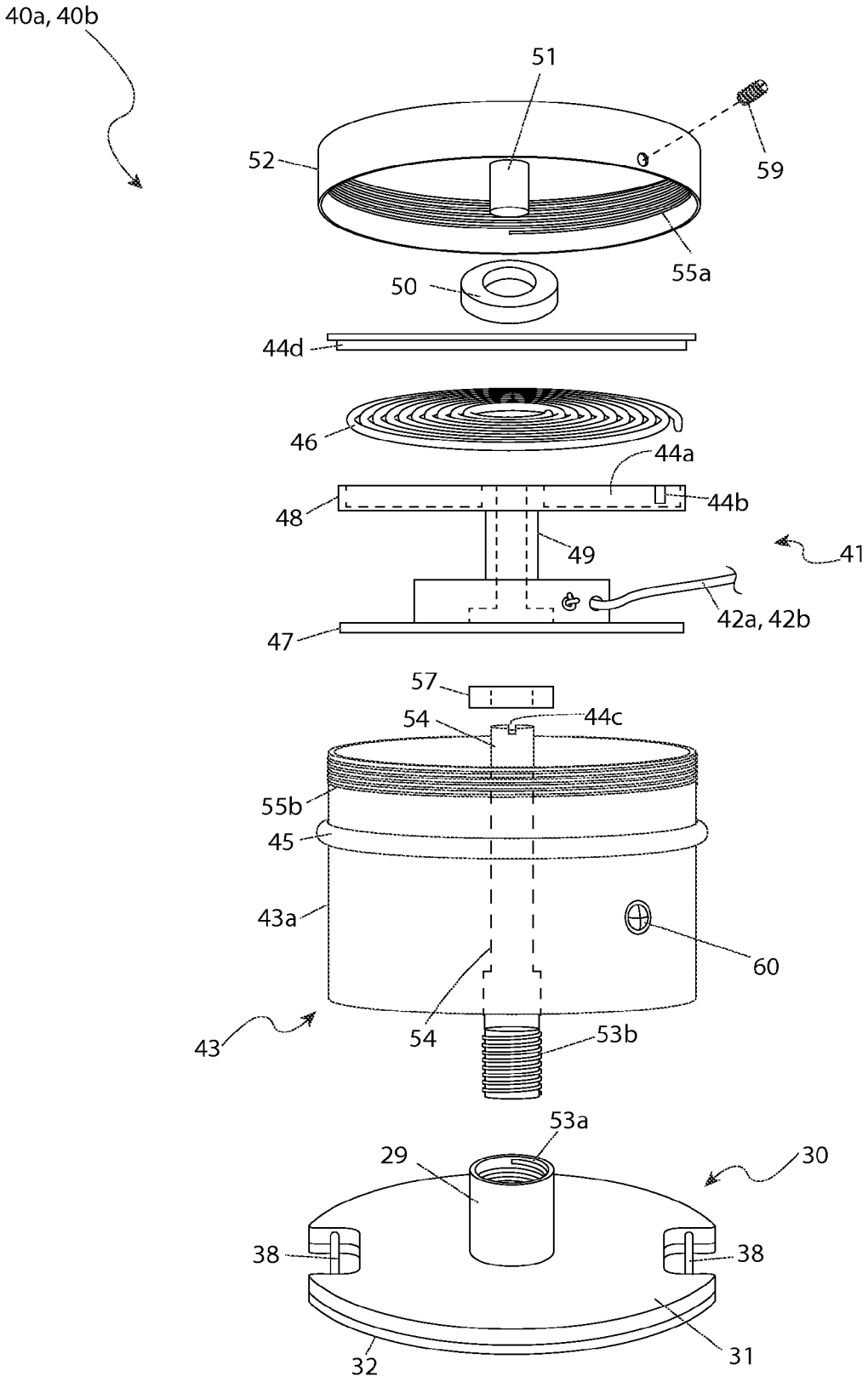
FIG. 3*b* is a sectional view of the retracting mechanism portion 40*a*, 40*b* of the sling for an archery bow 10 taken along section line B-B (see FIG. 3*a*), according to a preferred embodiment of the present invention; and, FIG. 4 is a sectional view of a shoulder pad portion 20 taken along section line A-A (see FIG. 2), according to a preferred embodiment of the present invention.

Referring now to FIGS. 3*a* and 3*b*, perspective and sectional views of a retracting mechanism portion 40*a*, 40*b* of the apparatus 10, according to a preferred embodiment of the present invention, are disclosed. The apparatus 10 provides identical first retracting mechanism 40*a* and a second retracting mechanism 40*b* portions, being removably attached to respective upper riser 16 and lower riser 18 portions of the bow 14. The retracting mechanisms 40*a*, 40*b* include a mounting assembly 30, a housing assembly 43, and a spool assembly 41. Each mounting assembly 30 provides an upwardly protruding cylindrical post member 29 having a post threaded portion 53*a* which in turn provides threaded attachment of a corresponding spindle threaded portion 53*b* of the spindle 54 of the housing assembly 43. Each mounting assembly 30 further provides an integral perpendicularly extending circular platen 31 at a bottom end which provides a mounting means onto the bow 14. Each platen 31 provides an adhesively bonded protective rubber pad 32 along a bottom surface to prevent marring a contact surface of the bow 14. Each mounting assembly 30 is affixed to the bow 14 via respective pairs of wrap-around strap portions 35 being affixed to opposing edges of the platen 31 using pin-type strap fasteners 38. The straps 35 provide securement around the bow 14 via engagement of the integral hook-and-loop surfaces 37 enabling the strap 35 to tightly encompass respective upper riser 16 and lower riser 18 portions of the bow 14 in a length-adjustable manner to enable secure installation of the apparatus 10 upon a variety of differently-sized bows 14. It should be appreciated that the straps 35 may utilize other attachment methods without limiting the scope of the invention. The mounting posts 30 provide offset clearance between the shoulder pad 20 and the bow 14 to avoid rubbing or unwanted engaging of the bow string portion during use.

The housing assembly 43 of each retracting mechanism 40*a*, 40*b* includes a cup-shaped housing 43*a*, a threaded cap 52, and a central vertical spindle 54. A spool assembly 41 is rotatingly mounted on the spindle 54. The spindle 54 acts as a stationary axle member which provides rotating attachment of torsion producing members to apply a constant tension upon the respective cords 42*a*, 42*b*. The spindle 54 is integral to the housing assembly 43 and extends upwardly from a central location upon an inner bottom surface of the housing cup 43. The housing cup 43*a* is a hollow open-topped cup-shaped vessel. The housing cap 52 has an internal cap threaded portion 55*a* that engages a housing cup threaded portion 55*b* on the housing cup 43*a*. An "O" ring 45 provides a seal for the housing assembly 43 to prevent dirt and water intrusion. The spool assembly 41 includes a spool 47, spool post 49, a spring holder 48, a spring 46, a spring holder cover 44*d*, a friction disc 50, and a bearing 57. The spool 47 winds the cord 42*a*, or 42*b* on the cylindrical spool post 49 between the horizontal flange of the spool 47 and the bottom surface of the spring holder 48. The cords 42*a*, 42*b* are envisioned to be tied or otherwise affixed to a spool post portion 49 of the spool 47.

The spring holder 48 includes a spring cavity 44*a* that receives and retains the coil-type spring 46. An outer end portion of the spring 46 is stationarily anchored to the spool assembly 41 via a first spring slot 44*b* of the spring holder 48. The inner end portion of the spring 46 is anchored to an integral second spring slot portion 44*c* of the spindle 54, thereby applying a rotating torsion upon the spool 47 to wind the respective cord 42*a*, 42*b* thereto. The top opening portion of the spring cavity 44*a* is covered by a flat circular spring holder cover 44*d* that is secured to the spring holder 48 via a press fit. The spool 47 is supported in the housing cup 43*a* by a bearing 57, and the friction disc 50 disposed about the cap post 51 contacts the spring cavity holder 44*d* and provides a controlled winding of the spool 47 within the housing assembly 43.

The housing assembly 43 also provides a cord aperture 60 along a side surface of the housing cup 43*a* which allows the respective cord 42*a*, 42*b* to motion into and out of the housing assembly 43 in such a manner as to minimizing entry of moisture during use. The cord aperture 60 is envisioned to be made of a circular rubber sheet with intersecting slits or other close-fitting means to minimize entry of moisture into the respective retracting mechanism 40*a*, 40*b*.

The respective retracting mechanism 40*a*, 40*b* further provides a means to control a velocity with which the spool assembly 41 rotates and the respective cord 42*a*, 42*b* is wound by utilizing a friction disc 50, positioned around the cap post 51, between the spring cavity cover 44*d*, and a bottom surface of the cap 52. The friction disc 50 is envisioned to be made of a low-friction material such as TEFLON®, nylon, or the like, and is adjustably acted upon by selectively engaging a second female threaded region 55*a* located along a bottom edge portion of the cap 52, with a second male threaded region 55*b* correspondingly sized and located along a top perimeter edge of the housing cup 43*a*. As the cap 52 is rotated by a user and the threads 55*a*, 55*b* are progressively engaged, the friction disc 50 is compressed to produce a friction force upon the spring cavity cover 44*d*, thereby resisting a rotary motion of the affixed spool 47 in an adjustable manner. Upon obtaining a desired amount of rotational resistance and corresponding cable winding speed, the cap 52 is secured in a non-rotating manner to the housing 43 via an impinging set screw 59 located along a side surface of the cap 52.

Referring now to FIG. 4, a sectional view of the shoulder pad 20 taken along section line A-A (see FIG. 2), according to a preferred embodiment of the present invention, is disclosed. The shoulder pad 20 comprises a covering 22 having an upper and a lower panel with a padding portion 23 disposed here between. The tie downs 25 provide "P"-shaped appendages which allow tying a particular length of the cords 42*a*, 42*b* thereto such that the bow 14 is positioned at an archers 12 hip area when the cords 42*a*, 42*b* are fully extended. Each tie down 25 includes integral portions including a perpendicular circular flat bottom portion 27 which is entrapped between the covering 22 and padding 23, and an integral top button-head feature 28, or similar feature, which enables the cords 42*a*, 42*b* to be wrapped around a center portion 26, knotted, and fixed in position thereto. The tie downs 25 are envisioned to be fabricated from durable materials such as plastic, rubber, or the like, yet it is known that other materials may be utilized without limiting the scope of the invention. It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1. The method of preparing the apparatus 10 for use upon an existing bow 14 may be achieved by performing the following steps: acquiring a model of the apparatus 10 having a desired color, camouflage pattern, or the like; positioning a mounting assembly 30 upon the upper riser 16 portion of the bow 14; wrapping the strap portions 35 around the upper raiser portion 16; connecting the straps 35 together by pressing upon overlapping hook-and-loop surfaces 37 of the straps 35; mounting the first retracting mechanism 40*a* to a mounting assembly 30 by engaging the respective a post threaded portion 53*a* and the a spindle threaded portion 53*b*; installing the remaining mounting post assembly 30 and second retracting mechanism 40*b* portions upon the lower riser 18 in like manner as described above; inserting the cords 42*a*, 42*b* through the cord aperture portions 60 of the housing cups 43*a* and tying the cords 42*a*, 42*b* to respective spools 47, if not previously installed in the retracting mechanisms 40*a*, 40*b*; and tying extending end portions of the cords 42*a*, 42*b* to the respective tie down portions 25 of the shoulder pad 20. The existing bow 14 equipped with the apparatus 10 is now ready for use.

The method of utilizing the existing bow 14 equipped with the apparatus 10 may be achieved by performing the following steps: the archer 12 grasping the bow 14 and positioning the shoulder pad 20 onto the shoulder of the archer 12; the archer 12 moving the bow 14 downward away from the shoulder toward the hip and upper leg thereby extending the retracting cords 42*a*, 42*b* from the first and second retracting mechanisms 40*a*, 40*b* and reaching a carry position for said bow 14; maintaining this carry position having the arm generally extended with the retracting cords 42*a*, 42*b* supporting the bow 14 in this manner until the archer 12 desires to shoot an arrow; upon deciding to shoot, the archer 12 raises the bow 14 to a shooting position allowing the shoulder pad 20 to slide from the shoulder and the cords 42*a*, 42*b* to retract into the retracting mechanisms 40*a*, 40*b* to a position parallel to, and offset from the bow 14 without further input from the archer 12; the archer performs a shooting event without interference from the sling 10; after the shooting event, the archer 12 grasps the shoulder pad 20 and replaces it on his shoulder beginning the extraction of the cords 42*a*, 42*b* from the retracting mechanisms 40*a*, 40*b* until the archer 12 moves the bow 14 back to the carry position as desired. Additionally, the archer 12 may nock an arrow prior to using the sling 10 and placing the bow 14 in the carry position. In this manner, by using the present invention, the archer benefits from a comfortable means to transport and support a bow 14 so as not to interfere with the bow's normal use.

An archer 12 may remove the apparatus 10 from the bow 14 in its entirety by releasing the straps 35 from the riser portions 16, 18 and removing the apparatus 10. An archer 12 may also remove the apparatus 10 in a partial manner to provide for easy reinstallation upon the bow 14 via detachment of the retracting mechanisms 40*a*, 40*b* from the mounting assemblies 30 by rotatingly disengaging the respective spindle threaded portion 53*b* from the post threaded portion 53*a*. The use of the apparatus 10 provides for the easy transportation of a bow 14 under field conditions, while positioning the bow 14 and a nocked arrow so as to remain instantly available for quiet and stealthy use.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An archery bow sling, comprising:

a shoulder pad;

a first cord having a distal end attached to said shoulder pad;

a second cord having a distal end attached to said shoulder pad;

a first retracting mechanism operatively attached to a proximate end of said first cord, comprising:

a housing assembly;

a mounting assembly adapted to removably attach said first retracting mechanism to a bow, comprising:

a platen having a plurality of straps adapted to secure said mounting assembly to said bow;

a protective pad affixed to said platen and adapted to be disposed between said platen and said how when said mounting assembly is affixed to said bow; and a post member adapted to provide an offset connection point to said housing assembly;

said housing assembly affixed to said mounting assembly;

a spool assembly disposed within said housing assembly; and, a second retracting mechanism affixed to said bow distant from said first retracting mechanism and operatively attached to a proximate end of said second cord;

wherein said proximate end of said first cord is affixed to said spool and said cord passes through said cord aperture.

2. The sling of claim 1, wherein said housing assembly further comprises:

a cup-shaped housing having a connector about an open end;

a cap adapted to engage said connector of said housing; and, a central vertical spindle disposed within said housing and extending through a bottom of said housing to provide a connection point to said mounting assembly.

3. The sling of claim 2, wherein said spool assembly further comprises:

a spool rotatingly mounted on said spindle;

a spring holder affixed to said spool and having a spring cavity;

a coil spring disposed within said spring cavity and having an internal end operatively attached to said spindle and an external end attached to said spring holder;

a spring holder cover affixed to said spring holder and adapted to encapsulate said coil spring within said spring holder; and, a friction disc rotatingly mounted on said spindle and in operative contact with said spring holder cover and said housing cap;

wherein said friction disc controls a retraction speed of said first retracting cord.

4. The sling of claim 3, wherein said second retracting mechanism is identical in structure to said first retracting mechanism.

5. The sling of claim 1, wherein said shoulder pad comprises an upper covering, a lower covering, a padding layer disposed there between, and at least one tie down adapted to provide an attachment point for said first and second cords.

6. The sling of claim 5, wherein at least one tie down is spool shaped having a circular flat bottom portion, a center portion, and a top head;

wherein said bottom portion is inserted through and entrapped by said aperture of said upper covering and wherein said cord is looped and tied about said center portion such that said top head retains said cord on said tie down.

7. The sling of claim 6, wherein said shoulder pad further comprises two tie downs, each adapted to individually provide an attachment point for each of said cords.

8. An archery bow sling, comprising:

a shoulder pad comprising an upper covering, a lower covering, a padding layer disposed there between;

a first retracting mechanism comprising a first mounting assembly adapted to removably attach said first retracting mechanism to a bow, a first housing assembly affixed to said first mounting assembly, a first cord aperture formed in said first housing assembly, and a first cord having a distal end attached to said shoulder pad and a proximate end attached to said first housing assembly and routed through said first cord aperture; and, a second retracting mechanism affixed to said bow distant from said first retracting mechanism comprising a second mounting assembly adapted to removably attach said second retracting mechanism to said bow, a second housing assembly affixed to said second mounting assembly, a second cord aperture formed in said second housing assembly, and a second cord having a distal end attached to said shoulder pad and a proximate end attached to said second housing assembly and routed through said second cord aperture;

wherein said first and said second mounting assemblies further comprise:

a platen having a plurality of straps adapted to secure a respective mounting assembly to said bow;

a protective pad affixed to said platen and adapted to be disposed between said platen and said bow when said respective mounting assembly is affixed to said bow; and, a post member adapted to provide an offset connection point to a respective housing assembly.

9. The sling of claim 8, wherein said first and said second housing assemblies further comprise:

a cup-shaped housing having a connector about an open end;

a cap adapted to engage said connector of said housing; and, a central vertical spindle disposed within said housing and extending through a bottom of said housing to provide a connection point to said mounting assembly.

10. The sling of claim 9, wherein said first and said second spool assemblies further comprise:

a spool rotatingly mounted on said spindle;

a spring holder affixed to said spool and having a spring cavity;

a coil spring disposed within said spring cavity and having an internal end operatively attached to said spindle and an external end attached to said spring holder; and, a spring holder cover affixed to said spring holder and adapted to encapsulate said coil spring within said spring holder.

11. The sling of claim 9, wherein said first and said second spool assemblies further comprise a friction disc rotatingly mounted on said spindle and in operative contact with said spring holder cover and said housing cap; wherein said friction disc controls the retraction speed of said retracting cord.

12. The sling of claim 8, wherein said shoulder pad further comprises at least one tie down adapted to provide an attachment point for said first and second cords.

13. The sling of claim 12, wherein at least one tie down is spool shaped having a circular flat bottom portion, a center portion, and a top head;

wherein said bottom portion is inserted through and entrapped by said aperture of said upper covering and wherein said cord is looped and tied about said center portion such that said top head retains said cord on said tie down.

14. The sling of claim 8, wherein said second retracting mechanism is identical in structure to said first retracting mechanism.

15. A method of utilizing an archery bow with a sling of the present invention, said method includes the steps of:

i. providing said sling comprising:

a. a shoulder pad;

b. a first cord having a distal end attached to said shoulder pad;

c. a second cord having a distal end attached to said shoulder pad;

d. a first retracting mechanism affixed to said bow and operatively attached to a proximate end of said first cord having a first mounting assembly adapted to removably attach said first retracting mechanism to said bow with a platen having a plurality of straps and a protective pad; and, e. a second retracting mechanism affixed to said bow distant from said first retracting mechanism and operatively attached to a proximate end of said second cord having a second mounting assembly adapted to removably attach said first retracting mechanism to said bow with a platen having a plurality of straps and a protective pad;

ii. grasping said bow and positioning said shoulder pad onto a shoulder;

iii. moving said bow downward away from said shoulder toward a hip and upper leg area, thereby extending said retracting cords from said first and second retracting mechanisms and reaching a carry position for said bow;

iv. maintaining said carry position until it is desired to shoot an arrow;

v. raising said bow to a shooting position, thereby allowing said shoulder pad to slide from said shoulder and allowing said retracting cords to retract into said retracting mechanisms until said cords reach a position parallel to, and offset from said bow;

vi. performing a shooting event;

vii. grasping said shoulder pad and replacing said pad upon said shoulder, thereby causing extraction of said retracting cords from said retracting mechanisms until said bow is returned to said carry position.

* * * * *